US007891119B2

(12) United States Patent
Neiley

(10) Patent No.: US 7,891,119 B2
(45) Date of Patent: Feb. 22, 2011

(54) ARTICULATING FOOTWEAR FOR SPORTS ACTIVITY

(75) Inventor: Roger Neiley, Laguna Beach, CA (US)

(73) Assignee: Flow Sports, Inc., San Clemente, CA (US)

( * ) Notice: Subject to any disclaimer, the term of this patent is extended or adjusted under 35 U.S.C. 154(b) by 893 days.

(21) Appl. No.: 11/622,421

(22) Filed: Jan. 11, 2007

(65) Prior Publication Data

US 2007/0169377 A1 Jul. 26, 2007

Related U.S. Application Data

(60) Provisional application No. 60/758,952, filed on Jan. 13, 2006.

(51) Int. Cl.
*A43B 5/04* (2006.01)

(52) U.S. Cl. ..... 36/119.1; 36/102; 36/54; 36/115; 36/50.5

(58) Field of Classification Search ..... 36/119.1, 36/102, 54, 115, 50.5, 117.6, 117.1
See application file for complete search history.

(56) References Cited

U.S. PATENT DOCUMENTS

| | | | | |
|---|---|---|---|---|
| 3,593,435 | A * | 7/1971 | Lange | 36/117.6 |
| 3,750,310 | A | 8/1973 | Messner et al. | |
| 4,499,675 | A * | 2/1985 | Perotto | 36/117.6 |
| 4,534,122 | A * | 8/1985 | MacPhail | 36/88 |
| 4,660,303 | A | 4/1987 | Courvoisier et al. | |
| 4,719,670 | A | 1/1988 | Kurt | |
| 4,723,364 | A * | 2/1988 | Marxer | 36/10 |
| 4,825,566 | A | 5/1989 | Sartor | |
| 4,949,479 | A | 8/1990 | Ottieri | |
| 5,174,050 | A * | 12/1992 | Gabrielli | 36/117.6 |
| 5,499,461 | A | 3/1996 | Danezin et al. | |
| 5,701,689 | A | 12/1997 | Hansen et al. | |
| 5,878,513 | A | 3/1999 | Annovi et al. | |
| 5,906,388 | A | 5/1999 | Neiley | |
| 5,918,897 | A | 7/1999 | Hansen et al. | |
| 6,226,898 | B1 | 5/2001 | Trimble et al. | |
| 6,993,860 | B2 * | 2/2006 | Bettiol | 36/54 |

(Continued)

FOREIGN PATENT DOCUMENTS

| | | |
|---|---|---|
| DE | 8714500 | 12/1987 |

(Continued)

OTHER PUBLICATIONS

Automated English language translation of the description and claims of DE 8714500 (item AI).

(Continued)

*Primary Examiner*—Ted Kavanaugh
(74) *Attorney, Agent, or Firm*—Fred C. Hernandez; Mintz Levin Cohn Ferris Glovsky and Popeo P.C.

(57) ABSTRACT

A boot includes an upper formed of articulating panels that permit portions of the boot to move in substantial independence from one another in response to loads experienced by the boot. The boot generally comprises a sports boot that is positioned around a wearer's foot for coupling to an external appliance, such as a snowboard, wakeboard, skating appliance (such as a blade or wheels), or any other appliance.

7 Claims, 4 Drawing Sheets

U.S. PATENT DOCUMENTS

| | | | | |
|---|---|---|---|---|
| 2001/0024028 | A1 | 9/2001 | Karol | |
| 2003/0154627 | A1* | 8/2003 | Hirayama | 36/10 |
| 2004/0020081 | A1 | 2/2004 | Symons et al. | |
| 2004/0226190 | A1 | 11/2004 | Elkington et al. | |
| 2005/0044748 | A1 | 3/2005 | Bettiol | |
| 2005/0066546 | A1 | 3/2005 | Elkington et al. | |
| 2005/0138849 | A1 | 6/2005 | Morrow et al. | |
| 2005/0204585 | A1* | 9/2005 | Loveridge et al. | 36/54 |
| 2005/0241189 | A1 | 11/2005 | Elkington et al. | |
| 2007/0151123 | A1* | 7/2007 | Cavasin | 36/10 |

FOREIGN PATENT DOCUMENTS

| | | |
|---|---|---|
| EP | 0 455 104 | 11/1991 |
| EP | 1 397 971 | 3/2004 |
| WO | WO 00/33692 | 6/2000 |

OTHER PUBLICATIONS

DJ500 proflex boot for ice skating www.tournament-sports.com/jackson_skates/productSearch.asp? Keyword=proflex.

* cited by examiner

ARTICULATING FOOTWEAR FOR SPORTS ACTIVITY

REFERENCE TO PRIORITY DOCUMENT

Benefit of priority under 35 U.S.C. §119(e) is claimed to U.S. Provisional Application Ser. No. 60/758,952, filed Jan. 13, 2006, to Roger Neiley, entitled "ARTICULATING FOOTWEAR FOR SPORTS ACTIVITY."

This application also is related to International PCT application No. PCT/US07/00866, filed the same day herewith.

The subject matter of each of the above noted provisional and international applications is incorporated by reference in its entirety by reference thereto.

SUMMARY

The disclosure relates to footwear, particularly the specialized type of footwear used in conjunction with an external appliance such as a snowboard, wakeboard or other sports apparatus.

There are many desirable characteristics for the design of footwear used in sports applications. The foot is desirably protected from impact, the highly mobile function of the foot is desirably supported to some extent while still allowing desired movements, and the footwear often desirably provides engagement surfaces for the attachment of appliances such as snowboard bindings and boards.

The three dimensional nature of the human foot necessitates that such footwear be formed into a complex shape. This is often done at the manufacturing level by stitching flat panels together or molding three dimensional panels and joining them into an enclosing form. This yields an outer structure for the piece of footwear that is more or less continuous and unified in nature.

When flexible materials such as leather and synthetic sheets are thus formed into three dimensional shapes, the structure becomes considerably more rigid. For example, a normal magazine, very flexible in nature, when rolled into a tube becomes rigid and unyielding. When a boot is closed snuggly around the foot, the same thing happens: flexible panels take on a stiffer and more supportive structure by the nature of their shaping.

In some areas of a boot this can be a desirable effect, providing enhanced support and protection for the foot. However, many activities require the foot to move throughout a certain range of motion in order for the user to maintain dynamic balance, steer the appliance, control speed or simply maneuver at will.

Typically, the materials used for the boot will be selected to achieve a desired degree of deformation to allow such function through bending or wrinkling of the structure. This type of flexation, however, tends to be unpredictable, inconsistent, temperature dependent and even uncomfortable if the shape of the boot deforms in a way that impacts the foot in side.

Disclosed is a footwear device, such as a boot, that allows mechanical flexation of the boot structure through the decoupling of selected, discontinuous panels. While such panels may remain connected by lightweight and ultra flexible bridging materials for the purpose of sealing out moisture or contaminants, these bridging materials do not necessarily provide significant structural support. Rather, the primary support panels are allowed to move with substantial independence from one another in response to outside loads. By localizing these articulating panels and managing their relative ranges of motion, each area of the boot can be allowed defined flexibility, with minimal impact of one area's characteristics upon another. Adjacent panels may be placed next to each other in the same approximate plane, or may be overlapping with some degree of fixation between them.

Additionally, by allowing articulation between components, individual panels can be fabricated with increased stiffness for improved support and protection. Designs which rely on deformation of fixed panels for flex are limited in the degree of support and protection by the need to consider overall function of the footwear structure. Often a boot that is stiff enough for protection is too rigid for proper function. The converse is also true in that soft boots that flex freely do a generally poor job of protecting the foot and providing needed support.

As shown in the accompanying drawings, articulating panels may be located in various areas of the boot. In some embodiments, the forefoot region may be allowed a certain amount of dorsi- and plantar-flexion to facilitate walking. The ankle area of the main boot body may be allowed articulation in various directions.

An additional important component in many footwear designs is the tongue, which is normally formed into a three dimensional curve—concave over the top of the foot and in front of the lower leg, plus L shaped between instep and shin area. Considering that appliances are often attached to the boot by means of straps which bear against the tongue area, it is important for this element to offer certain stiffness and pressure distribution characteristics for the protection of the foot. The disclosed features present a means by which the tongue can provide this type of protection through the use of more rigid materials, while retaining the ability of the foot to function through a natural range, avoiding unwanted deformation that is inherent in the design of a continuous panel.

Combining multiple elements of the design to allow articulation has an exemplary benefit of providing localized support and protection where desired, while still allowing a relatively free range of motion to the user. Secondarily, this range of motion occurs without the need for kinking or other undesirable flexation of panels located adjacent to the natural articulation points of the foot and ankle. The result for the user is secure and consistent fit throughout whatever range of motion is designed into the boot.

Among the devices provided herein is a footwear device that couples to a sport board, comprising an upper positioned on a sole, wherein the upper is configured to receive a foot and is at least partially formed of two or more panels that can move relative to one another to permit the upper to deform in response to loads.

In other embodiments, provided herein is a footwear device that couples to a sport board, comprising a sole; a lower portion that positions around a foot of a wearer, the lower portion attached to the sole; and an upper portion that positions around an ankle of the wearer, the upper portion attached to the lower portion at an attachment region positioned toward a front of the foot and detached from the lower portion at an articulation region positioned toward a rear of the foot in a manner that permits the upper portion to pivot in a forward direction relative to the lower portion about the attachment region.

In other embodiments, provided herein is a footwear tongue adapted to be at least partially positioned on an instep of a footwear device, comprising at least two distinct region, that are connected to one another along at least one connection zone, the regions configured to move relative to one another, wherein a first region is manufactured of a first material and a second region is manufactured of a second material having a stiffness different than the first material.

The details of one or more implementations are set forth in the accompanying drawings and the description below. Further features, aspects, and advantages will become apparent from the description, the drawings, and the claims.

DETAILED DESCRIPTION

Figure 1:
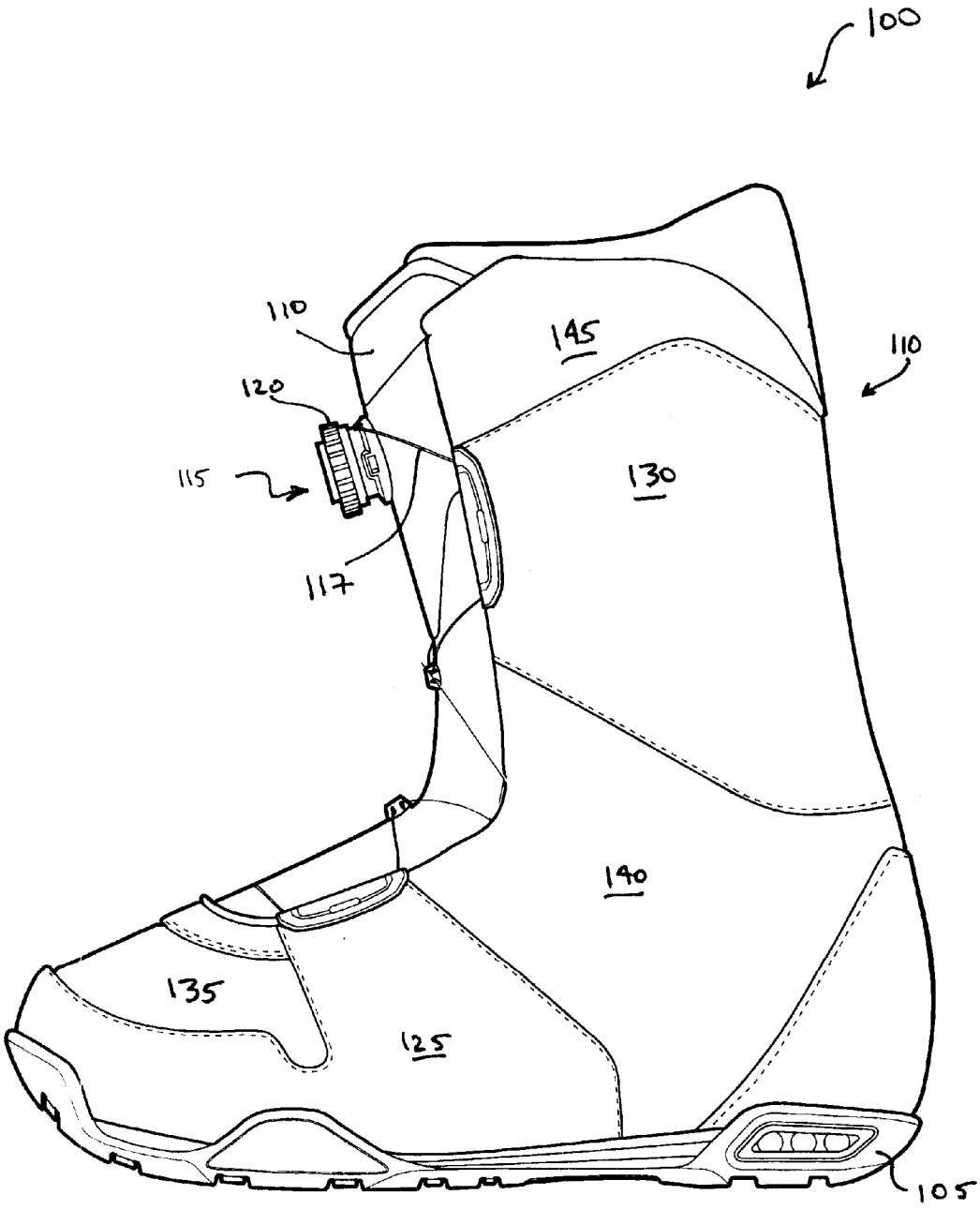
FIG. 1 shows a lateral side view of an exemplary embodiment of a boot.

FIG. 1 shows a side view of an exemplary embodiment of a boot 100 with an upper formed of articulating panels that permit portions of the boot to move in substantial independence from one another in response to loads experienced by the boot. The boot generally comprises a sports boot that is positioned around a wearer's foot for coupling to an external appliance, such as a snowboard, wakeboard, skating appliance (such as a blade or wheels), or any other appliance.

The boot 100 generally includes an outsole 105 and an upper 110 mounted above the outsole 105. The upper 105 includes a pair of closure flaps that at least partially cover a tongue 110 positioned along an insole region and a front region of the boot in a well known manner. A lacing system 115 includes a lace 117 that is threaded through the upper 110 and attached at opposite ends to a tightening mechanism 120. It should be appreciated that the boot 100 could be used with various types of lacing systems and need not include the tightening mechanism 120.

The upper 110 surrounds a person's foot and is at least partially formed of two or more panels that can move relative to one another to permit the upper 110 to deform in response to loads, such as loads generated during various movements of the foot and/or leg. The panels can be shaped and positioned in a predetermined manner to permit localized ranges of motion of the panels relative to one another. Each panel can have structural characteristics, such as flexibility and stiffness that are particularly suited for the location of the panel on the boot. Because the panels can move relative to one another, the structural characteristics of one panel have minimal or no effect on the structural characteristics of an adjacent panel.

With reference still to FIG. 1, the boot 100 includes overlay panels and underlay panels. The overlay panels at least partially cover or overlay a portion of the underlay panels and have a range of motion relative to the underlay panels. The overlay panels are sized such that portions of the underlay panels are exposed. It should be appreciated that the quantity and relative positions of the overlay and underlay panels can vary to suit desired articulation characteristics for the boot 100.

One or more of the underlay panels can be manufactured of a material that has increased flexibility relative to the overlay panels such that the underlay panels can articulate. In addition, the underlay panels are configured in a manner that permits relative movement between of the underlay panels relative to one another and relative to the overlay panels, as described below. The overlay panels can also be configured to have various levels of stiffness and relative movement to enable localized articulation and stiffness levels that meet desired criteria.

In the exemplary embodiment of FIG. 1, the boot 100 includes a side overlay panel 125 that is generally positioned along a lower side and toe region of the boot and an upper overlay panel 130 that is generally positioned along an upper side region of the boot such as in the general vicinity of the ankle or lower leg. FIG. 1 only shows one side of the boot 100. It should be appreciated that the panels 125 and 130 can extend around the boot to the opposite side that is not shown. Alternately, separate panels with similar or different placement to the panels 125 and 130 can be positioned on the opposite side of the boot 100.

The boot 100 also includes front underlay panel 135, a side underlay panel 140, and an upper underlay panel 145. The front underlay panel 135 is generally positioned in the toe region of the boot forward of the overlay panel 125, although a portion of the overlay panel 125 extends along a forward edge of the toe region. The side underlay panel 140 is positioned along a side region of the boot in-between the overlay panels 125 and 130. The upper underlay panel 145 is positioned along an upper region of the boot upward of the overlay panel 145. As mentioned, at least a portion of the underlay panels 145 extend beneath the overlay panels and in a manner that permits relative motion between the overlay and underlay panels. Thus, the portions of the underlay panels that are positioned beneath the overlay panels are not visible in FIG. 1.

Figure 2:
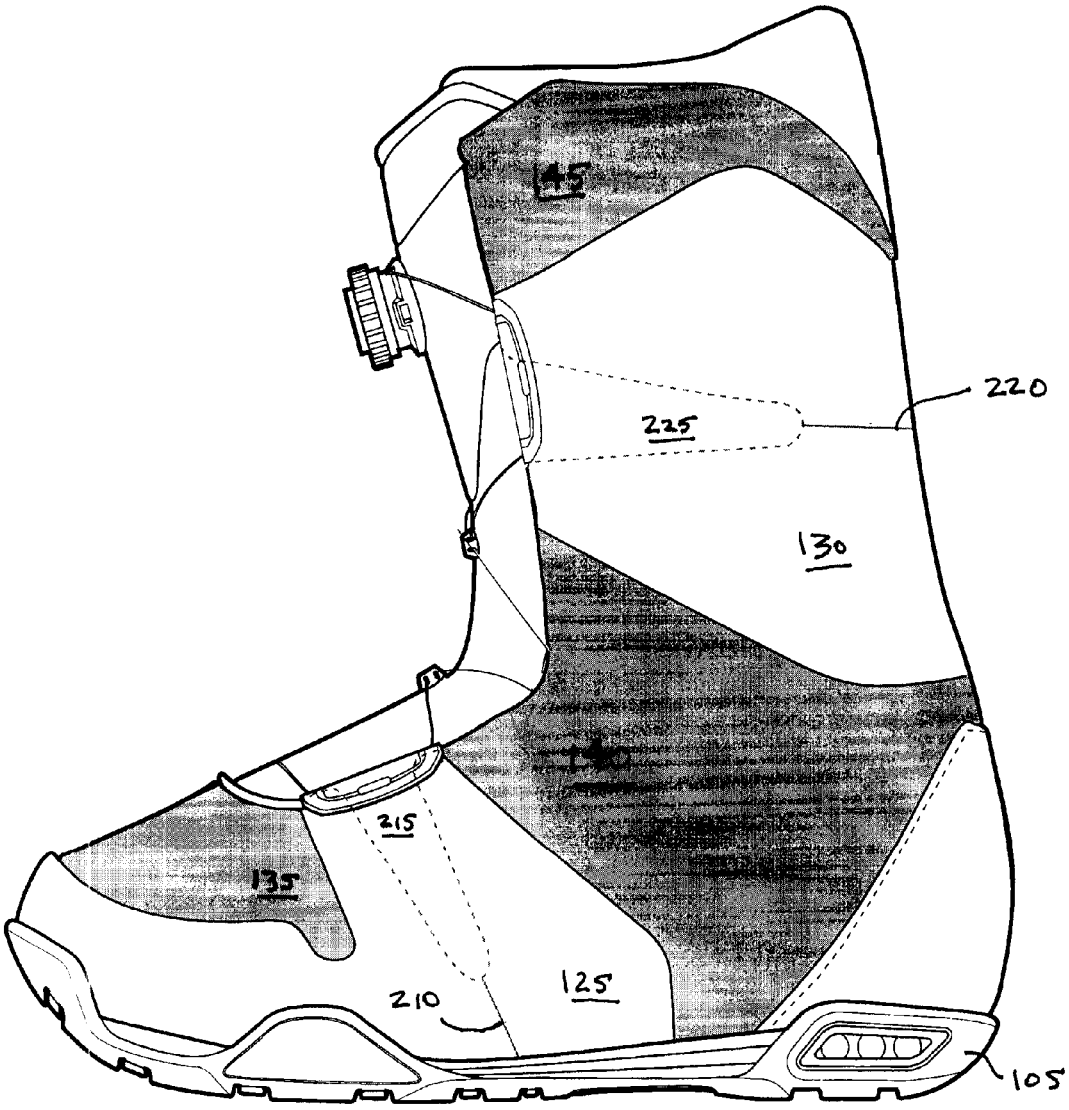
FIG. 2 shows a lateral side view of the boot of FIG. 1 revealing connections of underlay panels.

FIG. 2 shows a side view of the boot 100 and shows how the underlay panels are connected to one another. In an exemplary embodiment, the underlay panels are connected via seams positioned beneath the overlay panels. The underlay panels 135 and 140 are connected along a seam line 210 that is positioned on the side of the boot 100 beneath the overlay panel 125. The seam line 210 extends upwardly from the edge of the sole 105 to a cut-out 215 positioned in-between the underlay panels 140 and 135. The cut-out comprises an open area that serves as a region of articulation or relative motion between the underlay panels 135 and 140.

In a similar manner, the underlay panels 140 and 145 are connected along a seam line 220 located beneath the overlay panel 130. The seam line 220 can wrap around the rear of the boot to the opposite side of the boot from that shown in FIG. 2 or it can follow an alternate pathway. The seam line 215 has a forward edge that terminates at a cut-out 225 positioned in-between the underlays 140 and 145. The cut-out 225 comprises an open area between the underlay panels 140 and 145 that serves as a region of articulation or relative motion for the underlay panels 140 and 145.

It should be appreciated that the described underlay and overlay panels may be reversed in such a way that the articulating panels are external while the "covering" panels are internal to help seal out moisture. It is also possible for there to be no separate underlay and overlay panels, with the various articulating panels thus comprising the entire body of the boot.

In one embodiment, the cut-outs 215 and 225 are empty spaces in that no material is positioned in-between the underlay panels in the region of the cut-outs. In another embodiment the cut-outs are filled with a bridge material that interconnects the respective underlay panels. The cut-out material can be a lightweight, flexible, material that does not necessarily provide structural support to the boot, but that provides protection against the environment, such as sealing against moisture or other contaminants entering the boot.

As mentioned, the cut-outs 215 and 225 serve as regions of articulation or relative motion between the underlay panels. The cut-out 215 is positioned in the forefoot region of the boot and permits a range of motion between the underlay panels 135 and 140, such as to facilitate walking. The cut-out 225 is positioned in the upper ankle region and permits a range of motion between the underlay panels 140 and 145 to facilitate other foot and leg movements, such as climbing or medial-lateral flexation. The quantity, size, shape, and position of the cut-outs and the panels can be varied and selected to provide regions of articulation that facilitate various leg and foot movements, such as walking, climbing, as well as other movements/positions particularly associated with the sport or action for which the boot is used.

For example, the upper overlay panel 130 can be made of a stiffer material to provide strong support to the ankle region of the boot, while the underlay panels 145 and 140 in combination with the cut-out 225 permits some articulation in the upper ankle region. The overlay panels can be made of a stiffer material than the underlay panel (or vice-versa).

As mentioned, the overlay and underlay panels can each be made of a material of predetermined characteristics. The material of each overlay and underlay panel can be particularly selected to provide localized structural characteristics to particular region of the boot where the panel is located. Because the panels can move relative to one another, the structural characteristics of one panel do not necessarily affect the structural characteristics of an adjacent panel.

The overlay and underlay panels can be manufactured of any of a variety of materials and pursuant to any of a variety of techniques. In one embodiment, at least a part of each panel is manufactured by molding. The three dimensional nature of the human foot and lower leg may require that the overlay and underlay panels be formed into complex shapes. Molding of the overlay and underlay panels allows for the construction of a comfortable upper that conforms to the shape of the rider's foot and leg. Further, molding the panels limits the weight of the boot because less material is used compared to, for example, cutting and stitching together flat panels into a three-dimensional shape. Further, molded overlay and underlay panels can be engineered to maintain the desired flexing characteristics of the panels, including the ability to form a given panel with multiple flexing characteristics in discrete areas or in certain directions. The panels do not need to be isotropic in nature.

Figure 3:
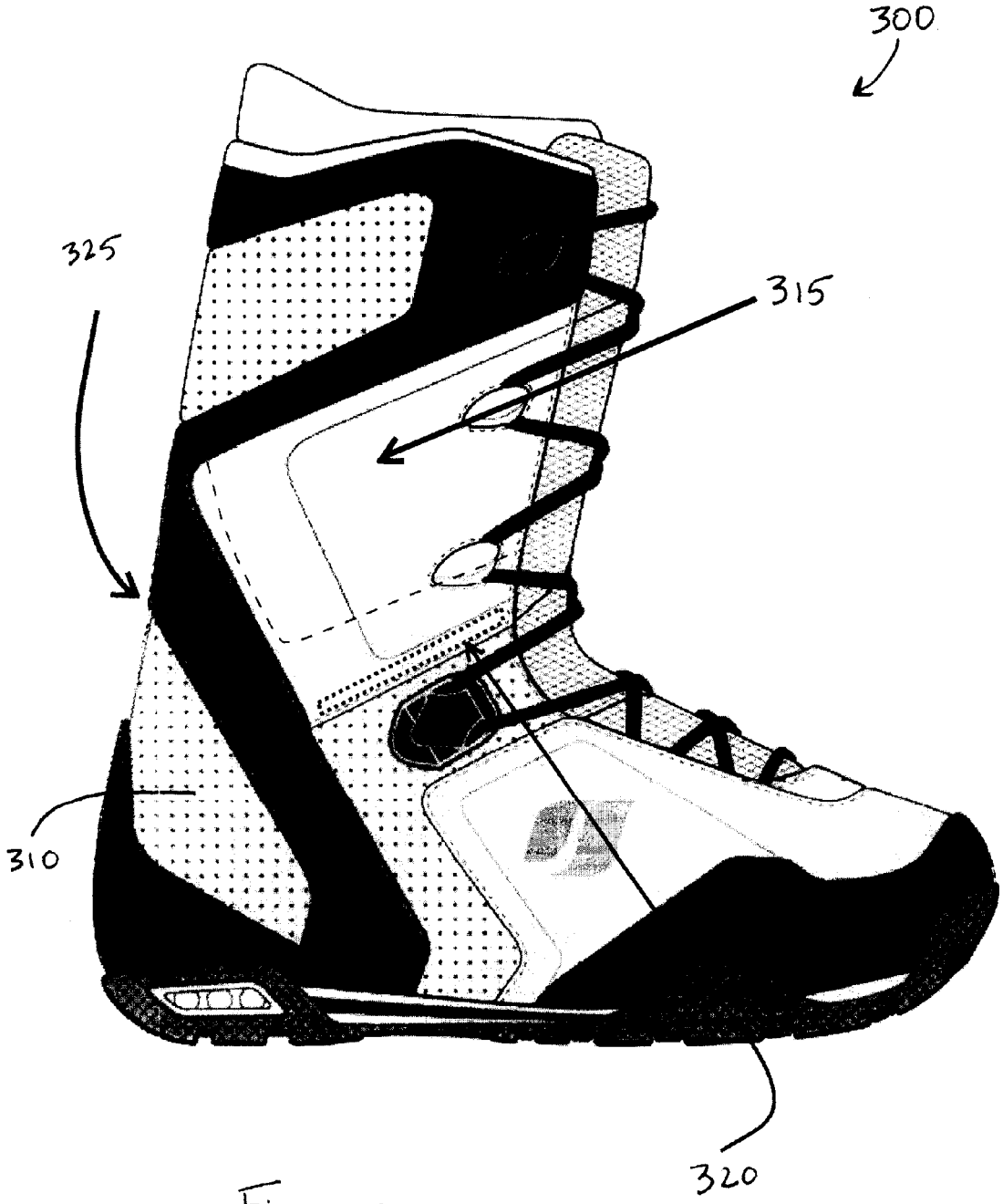
FIG. 3 shows a lateral side view of another embodiment of a boot.

FIG. 3 shows another embodiment of a boot, referred to as boot 300. In this embodiment, the upper is comprised of a lower region and an upper region that have a range of motion relative to one another. The upper region can be hinged relative to the lower region to permit relative movement therebetween or the upper region may be partially attached to the lower region, leaving a certain area unattached to allow for relative movement between the two regions.

With reference to FIG. 3, the boot 300 has an upper that includes a lower region 310 generally positioned around the foot and lower ankle region of the boot. The upper also includes an upper region 315 that is generally positioned around the upper ankle and lower leg region of the boot. The upper region 315 and lower region 310 meet one another along an attachment region 320. The attachment line 320 comprises a region where the lower region 310 and the upper region 315 connect to one another. The attachment can be via stitching, riveting, through the use of a continuous piece of material, or through other attachment means. The upper and lower regions can also articulate or move relative to one another along an articulation region 325. The upper and lower regions are not attached to one another along the articulation region 325. The upper region 315 can articulate or move independent of the lower region 310 along the articulation region 325.

Thus, the upper region 315 and lower region 310 are connected along the attachment region 320 at a frontward location of the boot and can articulate relative to one another along the articulation region 325 at a backward location of the boot. This permits the upper region 315 to pivot relative to the lower region with respect to a relatively fixed portion of the structure that is positioned near the front of the boot.

The boot of FIG. 3 can be particularly useful as a snowboard boot that is used with a snowboard binding having a rear highback that supports the rear of the boot. Such a binding is described in U.S. Pat. No. 5,918,897, which is incorporated herein by reference in its entirety. The rear highback provides support to the ankle region of the boot in backward lean, so there is no need for the boot itself to provide such support. Hence, the upper and lower regions are free at the rear of the boot thereby permitting relative movement in the rear. The free movement between the upper and lower regions at the rear of the boot permits the boot to articulate while not bulging outward at the lower part of the boot during forward flex. On the other hand, because the upper and lower regions of the boot 300 are fixed to one another at the front side, the boot provides some support at the front of the boot.

Figure 4:
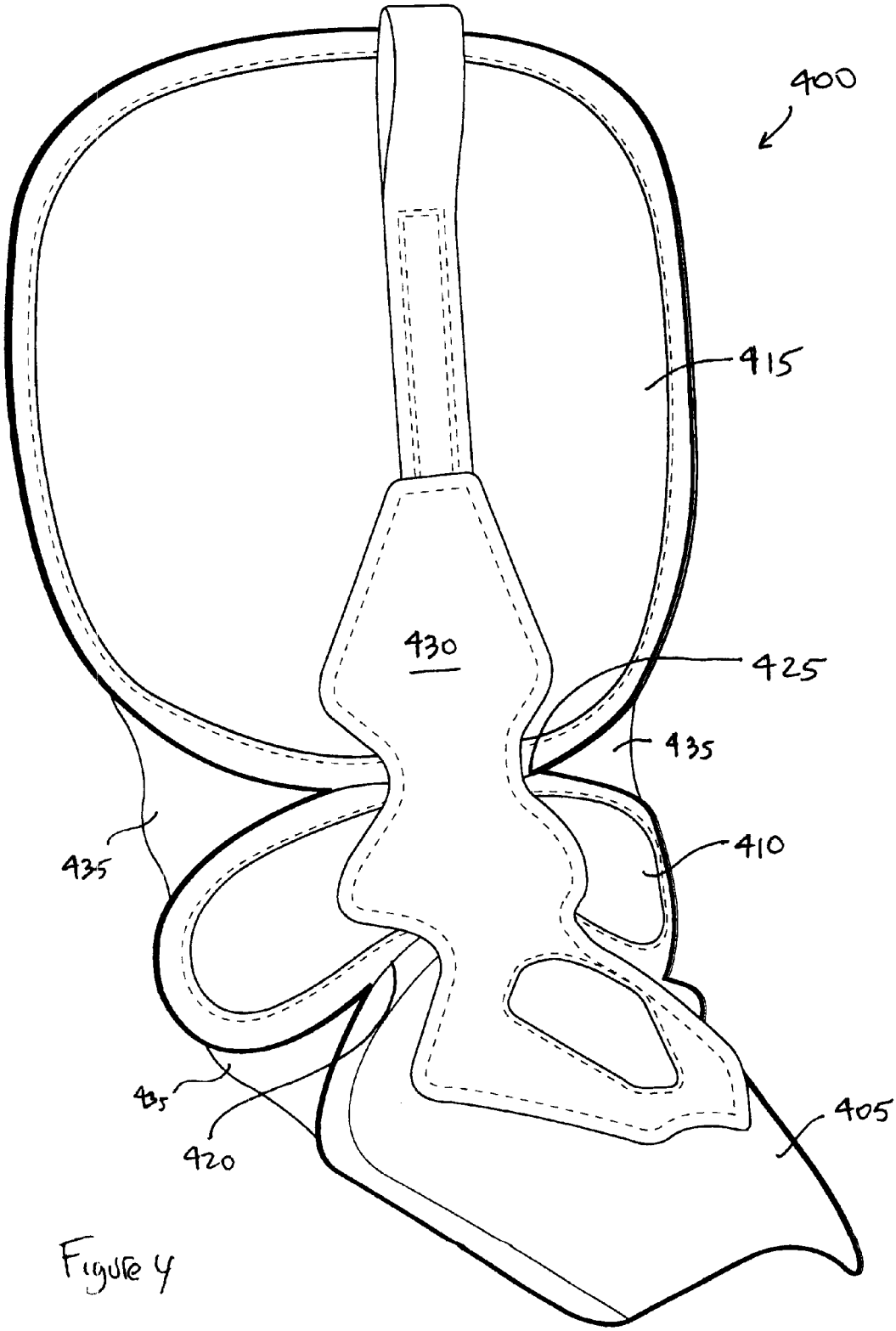
FIG. 4 shows a perspective view of an articulating tongue that can be incorporated into any of the boot embodiments described herein.

FIG. 4 shows an articulating tongue 400 that can be incorporated into any of the embodiments of the boots described herein. The tongue 400 includes two or more distinct regions that are connected to one another along predetermined connection zones. The regions can move relative to one another and can each be manufactured of a material having desired structural characteristics specifically suited to the location of the region on the tongue. Thus, the tongue can have localized desired structural characteristics, such as stiffness and pressure distribution characteristics for protection of the foot, while the relative movement of the regions permits the underlying foot to function through a natural range of motion. The size, shape, and location of the connection zone for each region is selected to provide the tongue with the ability to comfortably conform to the shape of the foot while still providing stiffness and protection where needed.

In the embodiment of FIG. 4, the tongue 400 includes an instep region 405, an intermediate region 410, and an upper region 415. The instep region 405 and intermediate region 410 are connected along a connection zone 420 which may be located along a center line or any other axis which need not be symmetrically located with respect to the main axis of the tongue. The intermediate region 410 and upper region 415 are connected along a connection zone 425. A front strip 430 is positioned on top of the regions 405, 410, 415 and extends across all of the regions. It should be appreciated that the quantity and shapes of the region, can vary.

At the connection zones 420 and 425, the regions have reduced outward lateral dimensions such that each region flares laterally outward moving away from the connection zones. This shape permits each tongue region to locally conform to the shape of the foot where the tongue region is located with minimal impact on the shape, function and structure of the tongue as a whole.

Filler regions 435 are positioned between the regions 405, 415, 420. The filler regions 432 can be manufactured of a lightweight, flexible material that does not contribute to the overall structural characteristics (such as flexibility and rigidity) of the tongue 400. However, the filler regions 435 can be shaped and can be manufactured of a material to permit the tongue to properly seal around the instep of the foot, such as to prevent moisture or other contaminants from entering the boot.

Each region can be manufactured of a different material that provides desired structural characteristics to the particular region of the tongue where the region is located. For example, if a strap is to bear against a particular region, that region can be manufactured of a material that protects the foot against the pressure points of the strap. On the other hand, a region that does not bear a strap can be made of a soft material that emphasizes comfort. In this manner, the regions can be sized, shaped, and manufactured to provide localized characteristics to different areas of the tongue.

Although embodiments of various methods and devices are described herein in detail with reference to certain versions, it should be appreciated that other versions, embodiments, methods of use, and combinations thereof are also possible. Therefore the spirit and scope of the disclosure should not be limited to the description of the embodiments contained herein.

What is claimed:

1. A footwear device that couples to a sport board, comprising:

an upper positioned on a sole, wherein the upper is configured to receive a foot and is at least partially formed of two or more panels that can move relative to one another to permit the upper to deform in response to loads, wherein the panels include overlay panels and underlay panels located at least partially below the overlay panels, and wherein the overlay panels can move relative to the underlay panels wherein the underlay panels are connected via seams positioned below the overlay panels, and wherein the underlay and overlay panels include:

(a) at least one side overlay panel positioned along a lower side and toe region of the footwear device;

(b) at least one upper overlay panel positioned along an upper side region of the footwear device;

(c) a one front underlay panel positioned in a toe region of the footwear device;

(d) a side underlay panel positioned along a side region of the boot; and (e) an upper underlay panel positioned along an upper region of the boot;

wherein the front underlay panel, the side underlay panel, and the upper underlay panel all define an outermost surface of the footwear device.

2. A footwear device as in claim 1, further comprising a tongue attached to the upper, wherein the tongue is positioned adjacent an upper region of the footwear device and wherein the tongue includes two or more distinct regions that are connected to one another along predetermined connection zones, the regions configured to move relative to one another, wherein the regions can each be manufactured of a material having desired structural characteristics specifically suited to the location of the region on the tongue.

3. A footwear device as in claim 1, wherein the panels are molded of non-woven material.

4. A footwear device as in claim 1, wherein the overlay panels are made of a material that is more flexible than a material of the underlay panels.

5. A footwear device as in claim 1, wherein the underlay panels are made of a material that is more flexible than a material of the overlay panels.

6. A footwear device as in claim 1, wherein cut-out regions are positioned between the underlay panels to permit relative motion between the underlay panels.

7. A footwear device as in claim 6, wherein the cut-out regions are filled with a material that is flexible.

* * * * *